US011815263B2

(12) United States Patent
Nam

(10) Patent No.: US 11,815,263 B2
(45) Date of Patent: Nov. 14, 2023

(54) FUEL TRANSFER APPARATUS AND BOILER FACILITY INCLUDING SAME

(71) Applicant: DOOSAN HEAVY INDUSTRIES & CONSTRUCTION CO., LTD., Changwon-si (KR)

(72) Inventor: Gyeong Mo Nam, Yongin-si (KR)

(73) Assignee: DOOSAN HEAVY INDUSTRIES & CONSTRUCTION C, Gyeongsangnam-do (KR)

( * ) Notice: Subject to any disclaimer, the term of this patent is extended or adjusted under 35 U.S.C. 154(b) by 330 days.

(21) Appl. No.: 17/036,174

(22) Filed: Sep. 29, 2020

(65) Prior Publication Data

US 2021/0108794 A1 Apr. 15, 2021

(30) Foreign Application Priority Data

Oct. 15, 2019 (KR) ..... 10-2019-0127691
Oct. 24, 2019 (KR) ..... 10-2019-0133060

(51) Int. Cl.
*F23B 40/02* (2006.01)
*F23K 3/02* (2006.01)

(52) U.S. Cl.
CPC ..... *F23B 40/02* (2013.01); *F23K 3/02* (2013.01); *F23K 2203/006* (2013.01); *F23K 2203/008* (2013.01)

(58) Field of Classification Search
CPC ..... F23K 3/02
See application file for complete search history.

(56) References Cited

U.S. PATENT DOCUMENTS 4,381,718 A * 5/1983 Carver ..... F23D 1/02 110/342
4,589,260 A * 5/1986 Krockow ..... F23R 3/286 60/737
4,638,747 A * 1/1987 Brock ..... E01C 19/10 110/101 CC (Continued)

FOREIGN PATENT DOCUMENTS

DE 3124571 A1 * 6/1983 ..... F23K 3/02
GB 2138120 A * 10/1984 ..... F23D 1/02

(Continued)

*Primary Examiner* — David J Laux
(74) *Attorney, Agent, or Firm* — INVENSTONE Patent, LLC

(57) ABSTRACT

A boiler facility includes first and second fuel transfer apparatuses for transporting fine particulate fuel to a combustor. A first fuel transfer apparatus includes a main body and a diffuser. The main body has a flow space through which fuel is transferred and an inner surface that defines the flow space of the main body and includes a lower inner surface that extends obliquely downward. The diffuser is installed at a downstream end of the main body, the diffuser having a flow space through which fuel is transferred and an inner surface that defines the flow space of the first diffuser and includes a lower inner surface that extends obliquely upward. A second fuel transfer apparatus includes a transfer pipe having a flow channel, a second diffuser installed along the inner circumferential surface of the transfer pipe, and a guide installed in the second diffuser and inclined downward.

5 Claims, 21 Drawing Sheets

(56) References Cited

U.S. PATENT DOCUMENTS

| | | | | | |
|---|---|---|---|---|---|
| 5,415,539 | A * | 5/1995 | Musil | F23C 7/004 | 239/404 |
| 5,529,000 | A * | 6/1996 | Hartel | F23D 1/00 | 110/104 B |
| 5,588,380 | A * | 12/1996 | LaRose | F23D 1/00 | 110/263 |
| 6,055,913 | A * | 5/2000 | Gerber | F23D 1/00 | 29/889.6 |
| 6,058,855 | A * | 5/2000 | Ake | F23L 9/04 | 110/208 |
| 6,152,051 | A * | 11/2000 | Kiyama | F23D 1/00 | 110/104 B |
| 7,104,251 | B2 * | 9/2006 | Kim | F01N 13/08 | 123/306 |
| 8,991,323 | B2 * | 3/2015 | Larue | F23K 3/02 | 110/260 |
| 2003/0104328 | A1 * | 6/2003 | Kobayashi | F23C 6/047 | 431/10 |
| 2006/0281036 | A1 * | 12/2006 | Sarv | F23D 17/002 | 431/185 |
| 2007/0207426 | A1 * | 9/2007 | Perry | F23L 7/005 | 431/183 |
| 2015/0053124 | A1 * | 2/2015 | Taniguchi | F23C 6/045 | 431/284 |

FOREIGN PATENT DOCUMENTS

| | | | |
|---|---|---|---|
| JP | 63-58007 | A | 3/1988 |
| JP | 63-18087 | B2 | 4/1988 |
| JP | 3062582 | B2 | 7/2000 |
| JP | 2002-228068 | A | 8/2002 |
| JP | 2014-085050 | A | 5/2014 |
| KR | 10-0709849 | B1 | 4/2007 |

* cited by examiner

FUEL TRANSFER APPARATUS AND BOILER FACILITY INCLUDING SAME

CROSS REFERENCE TO RELATED APPLICATION

The present application claims priority to Korean Patent Application No. 10-2019-0127691, filed on Oct. 15, 2019, and No. 10-2019-0133060, filed on Oct. 24, 2019 the entire contents of which are incorporated herein for all purposes by this reference.

BACKGROUND OF THE DISCLOSURE

1. Field of the Invention

The present disclosure relates to a fuel transfer apparatus and a boiler facility including the same. More particularly, the present disclosure relates to a fuel transfer apparatus for transporting fine particulate fuel to a combustor, and a boiler facility for generating steam to be supplied to a steam turbine.

2. Description of the Background Art

Generally, a turbine such as a steam turbine or a gas turbine is a power generator that converts the thermal energy of a fluid into mechanical energy such as a rotational force.

The steam turbine is a combination of a high-pressure (HP) turbine, an intermediate-pressure (IP) turbine, and a low-pressure (LP) turbine that are connected in series or in parallel. The steam turbine rotates a generator with rotary motion of the rotor so that the generator can generate electricity. The amount of electricity generated depends on the temperature and pressure of steam. In order to drive the steam turbine, a thermal power plant is equipped with a boiler that generates hot high-pressure steam.

In a thermal power plant that uses coal as the main fuel, finely powdered coal (i.e., pulverized coal) and air are supplied to a boiler and are burned in a combustion chamber of the boiler to generate heat, and this heat boils water in the evaporator of the boiler so that the evaporator generates steam. The steam generated in this manner drives the steam turbine. Such thermal power plants are advantageous over hydraulic power plants or nuclear power plants in terms of simpler structure, lower construction costs, and shorter construction time. In addition, thermal power plants have high thermal efficiency because power generation in the power plants is performed by directly applying heat to the evaporator.

Flaming coal that is one of the fuels commonly used in the boiler contains a large amount of volatile substance and thus makes flames while burning. Among the types of flaming coal are peat, lignite, brown coal, and bituminous coal. Most of them are high in caloric value and are thus used for power generation.

A conventional boiler facility includes a fuel transfer apparatus that supplies fine particulate fuel to a combustor. The conventional fuel transfer apparatus has a problem in that when fuel is transferred through a long horizontal pipe, there is a possibility that fuel settles and stagnates on the inner surface of the pipe due to gravity or when the velocity of fluid is low. In this case, the distribution of the fuel in the pipe of the conventional fuel transfer apparatus is uneven, resulting in a reduction in the combustion efficiency of the combustor.

On the other hand, a conventional boiler facility includes a fuel transfer apparatus that supplies fine particulate fuel to a combustor. The conventional fuel transfer apparatus has a problem in that when fuel is transferred through a long pipe, fuel is locally concentrated on the inner surface of the pipe due to gravity or due to bent portions of the pipe. Due to the uneven distribution of the fuel in the pipe of the conventional fuel transfer apparatus, the pipe is locally severely worn at a region where the fuel stagnates. In addition, since unevenly distributed fuel is supplied to the combustor, the combustion efficiency of the combustor deteriorates.

SUMMARY OF THE DISCLOSURE

The present disclosure has been made in order to solve the problems occurring in the related art. An objective of the present disclosure is to provide a fuel transfer apparatus capable of preventing fuel from settling and stagnating on the inner surface of a pipe and from being unevenly distributed in the pipe and to provide a boiler facility including the apparatus.

The present disclosure provides a fuel transfer apparatus for transporting fine particulate fuel to a combustor, the apparatus including a main body having a flow space through which fuel is transferred and an inner surface that defines the flow space of the main body, the inner surface of the main body including a lower inner surface that extends obliquely downward in a flow direction of the fuel; and an ejection portion installed at a downstream end of the main body, the ejection portion having a flow space through which fuel is transferred and an inner surface that defines the flow space of the ejection portion, the inner surface of the ejection portion including a lower inner surface that extends obliquely upward in the flow direction of the fuel.

The ejection portion may be inwardly curved and extend from the main body in the flow direction of the fuel.

The apparatus may further include a connection portion provided between the main body and the ejection portion, the connection portion having a constant diameter along the flow direction of the fuel, wherein the ejection portion extends from the connection portion linearly and obliquely inward in the flow direction of the fuel.

The main body may have a diameter that increases in the flow direction of the fuel.

The present disclosure further provides a fuel transfer apparatus for transporting fine particulate fuel to a combustor, the apparatus including a main body having a flow space through which fuel is transferred; and a swirler installed in the main body and configured to create a swirling flow of the fuel flowing through the main body.

The present disclosure provides a boiler facility that generates steam to be supplied to a steam turbine, the boiler facility including a silo; a pulverizer to produce fine particulate fuel by pulverizing fuel supplied from the silo; a combustor that burns the fine particulate fuel; an evaporator installed on one side of the combustor and configured to be heated in order to produce steam by vaporizing externally supplied water; and a fuel transfer apparatus installed between the pulverizer and the combustor and configured to transport the fine particulate fuel to the combustor, the fuel transfer apparatus including a main body having a flow space through which fuel is transferred; and a swirler installed in the main body and configured to generate a swirling flow of the fuel in the main body.

The swirler may include a swirling body that includes a hollow and is spaced apart from an inner wall of the main body; and a plurality of ridge-shaped supports installed on an outer circumferential surface of the swirling body so as to be in contact with an inner surface of the main body to support the swirling body.

The plurality of ridge-shaped supports may be spaced apart from each other in a circumferential direction of the main body and aligned with a central axis of the main body.

Alternatively, the plurality of ridge-shaped supports may be spaced apart from each other in a circumferential direction of the main body, and each of the plurality of ridge-shaped supports may be inclined relative to a central axis of the main body. Each of the plurality of ridge-shaped supports may include an upstream end and a downstream end, the upstream end meeting an imaginary plane that includes the central axis of the main body, the downstream end shifted from the imaginary plane in the circumferential direction.

The swirling body may have a diameter that increases in the flow direction of the fuel.

The present disclosure provides a fuel transfer apparatus for transporting fine particulate fuel to a combustor, the apparatus including a transfer pipe having a flow space through which fuel is transferred; a diffuser installed on an inner circumferential surface of the transfer pipe; and a guide disposed on the diffuser, the guide having an upper surface that extends from the diffuser obliquely downward toward a radial center of the transfer pipe.

The diffuser may have an annular shape and an outer circumferential surface, the diffuser installed such that the outer circumferential surface contacts an inner circumferential surface of the transfer pipe, and the guide may include a plurality of guides installed on an inner circumferential surface of the diffuser and arranged at intervals in a circumferential direction of the diffuser. The diffuser may include an upper surface that is perpendicular to the inner circumferential surface of the transfer pipe. Each of the plurality of guides may include an upper surface that is concavely curved. Each of the plurality of guides may have a plate shape and extend obliquely downward toward the radial center of the transfer pipe. The diffuser may include a lower surface that extends obliquely upward toward the radial the transfer pipe. Each of the plurality of guides may include a lower surface that is concavely curved. The diffuser may include a first portion disposed on a first side with respect to a central axis of the transfer pipe and a second portion disposed on a second side opposite to the first side, the first portion having a radial thickness that is smaller than a radial thickness of the second portion, and the plurality of guides may include a plurality of first guides arranged on the first side at a first interval in the circumferential direction of the diffuser and a plurality of second guides arranged on the second side at a second interval in the circumferential direction of the diffuser, the first interval being longer than the second interval. The diffuser may include a first portion disposed on a first side with respect to a central axis of the transfer pipe and a second portion disposed on a second side opposite to the first side, and the plurality of guides may include a first guide disposed on the first side and a second guide disposed on the second side, the first guide having a shape different from that of the second guide.

The diffuser may be composed of multiple diffusers that are arranged at intervals in the circumferential direction of the transfer pipe, and the guide may be composed of multiple guides each of which is installed next to an end of a corresponding one of the multiple diffusers in the circumferential direction of the transfer pipe. The upper surface of each guide may extend obliquely downward from the corresponding diffuser. Each guide may be planar in shape and may extend obliquely downward toward from the corresponding diffuser. The multiple guides may be provided in multiple pairs, and the guide in each pair may be disposed on left and right sides of the corresponding diffuser, respectively.

The present disclosure provides A boiler facility for generating steam to be supplied to a steam turbine, the boiler facility including a silo; a pulverizer to produce fine particulate fuel by pulverizing fuel supplied from the silo; a combustor to burn the fine particulate fuel; an evaporator installed on one side of the combustor and configured to be heated in order to produce steam by vaporizing externally supplied water; and a fuel transfer unit installed between the pulverizer and the combustor and configured to transport the fine particulate fuel to the combustor, the fuel transfer unit including a first fuel transfer apparatus disposed perpendicular to a direction of gravity, and a second fuel transfer apparatus disposed parallel to the direction of gravity. The first fuel transfer apparatus may include a main body having a flow space through which fuel is transferred and an inner surface that defines the flow space of the main body, the inner surface of the main body including a lower inner surface that extends obliquely downward in a flow direction of the fuel; and a first diffuser installed at a downstream end of the main body, the first diffuser having a flow space through which fuel is transferred and an inner surface that defines the flow space of the diffuser, the inner surface of the diffuser including a lower inner surface that extends obliquely upward in the flow direction of the fuel. The second fuel transfer apparatus may include a transfer pipe having a flow space through which fuel is transferred; a second diffuser installed on an inner circumferential surface of the transfer pipe; and a guide installed in the second diffuser, the guide having an upper surface that extends from the second diffuser obliquely downward toward a radial center of the transfer pipe.

According to the present disclosure, the fuel transfer apparatus and the boiler facility including the same may have a diffuser having a diameter that gradually decreases in a direction in which fuel flows. Therefore, when fuel flows through a pipe, the fuel flows along the inner surface of the diffuser, so that the fuel can be easily dispersed in the pipe. According to the present disclosure, the fuel transfer apparatus and the boiler facility including the same can prevent fuel from settling and stagnating on the inner surface of a pipe and can evenly distribute fuel in the pipe, thereby ensuring the optimum fuel combustion efficiency of the combustor.

On the other hand, the fuel transfer apparatus according to the present disclosure and the boiler facility including the same may have a diffuser and a guide disposed inside a transfer pipe through which fuel is transferred, thereby ensuring that fuel flowing along the inner surface of the transfer pipe is evenly distributed in the entire region of the transfer pipe, and providing a uniformly mixed fuel to the combustor so that the combustion efficiency of the combustor can be improved.

In addition, in the fuel transfer apparatus and the boiler facility including the same apparatus, a plurality of guides may be installed on the inner circumferential surface of a diffuser, an upper surface of each guide extending obliquely downward. This reduces an impact angle of the fuel with respect to the guides, thereby preventing the guides from being worn due to a collision with fuel. In addition, according to the present disclosure, the upper surface of each guides may extend obliquely downward and a lower surface of each guide may extend obliquely upward. This reduces the size of a vortex formed in the fuel passing through the guides.

On the other hand, in the fuel transfer apparatus according to the present disclosure and the boiler facility including the same, the guide may be installed at an end of the diffuser in the circumferential direction of the transfer pipe, thereby forming a circumferentially swirling flow in the transfer pipe and thus uniformly mixing the fuel over the entire region of the transfer pipe.

DETAILED DESCRIPTION OF THE DISCLOSURE

Figure 1:
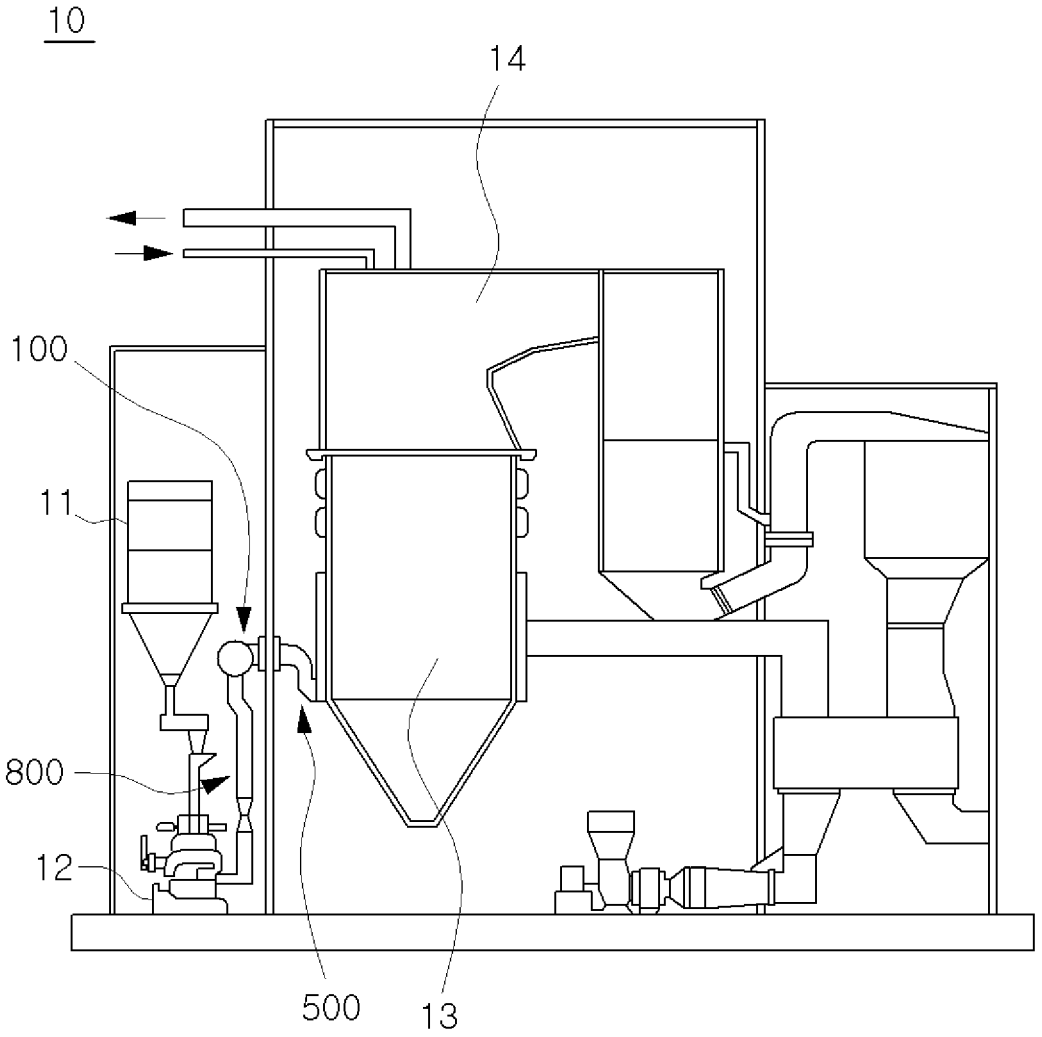
FIG. 1 is a schematic view of a boiler facility according to the present disclosure.

Referring to FIG. 1, a boiler facility 10 according to the present disclosure includes a silo 11, a pulverizer 12, a combustor 13, an evaporator 14, and a fuel transfer unit 100, 500, 800. The silo 11 stores solid fuel such as coal. The pulverizer 12 crushes (pulverizes) the solid fuel transferred from the silo 11, thereby producing fine particulate fuel. The combustor 13 burns the fuel supplied from the pulverizer 12, thereby generating combustion heat. The evaporator 14 is installed on one side of the combustor 13 and receives water from the outside. The evaporator 14 evaporates the supplied water with the combustion heat transferred from the combustor 13 and generates steam. The steam is supplied to a steam turbine (not illustrated) so as to drive the steam turbine. In the present disclosure, thermal power generation refers to a process of generating electricity by driving the boiler facility 10 of the present disclosure and the steam turbine.

The fuel transfer unit 100, 500, 800 is installed between the pulverizer 12 and the combustor 13 and functions to transfer fine particulate fuel from the pulverizer 12 to the combustor 13. The fuel transfer unit 100, 500, 800 includes a first fuel transfer apparatus 100 disposed perpendicular to the direction of gravity G, i.e., horizontally, and a second fuel transfer apparatus 500, 800 disposed parallel to the direction of gravity G, i.e., vertically.

Figure 2:
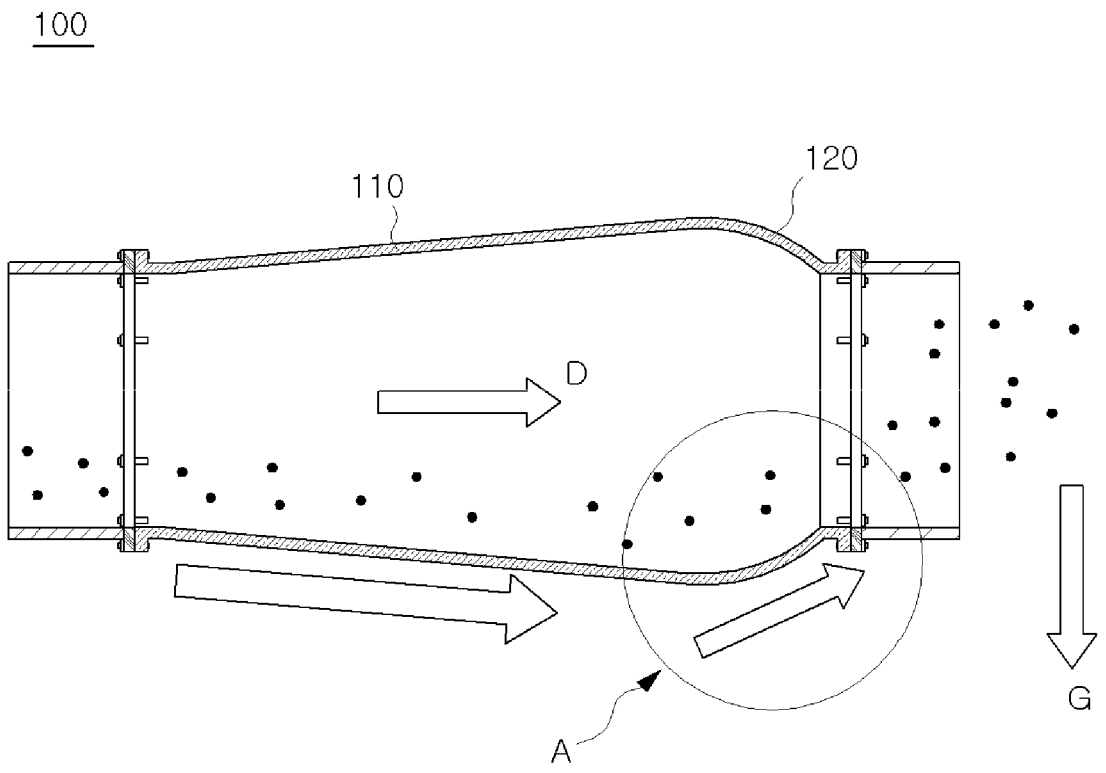
FIG. 2 is a cross-sectional view of a first fuel transfer apparatus of FIG. 1 according to a first embodiment of the present disclosure.
Figure 3:
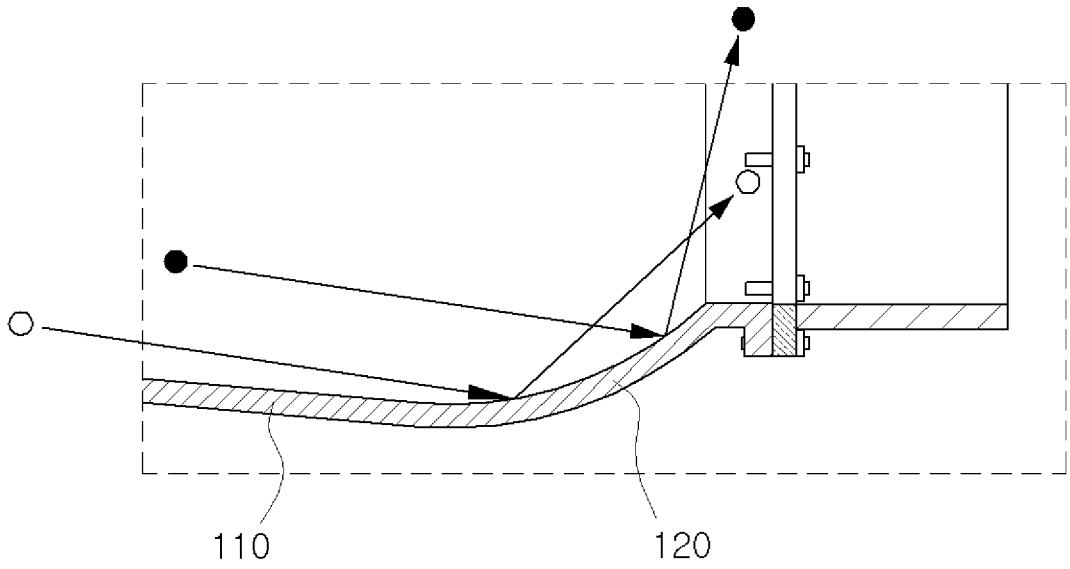
FIG. 3 is an enlarged view of a portion A in FIG. 2.

Referring to FIGS. 2 and 3, the first fuel transfer apparatus 100 according to a first embodiment of the present disclosure includes a main body 110 and an ejection portion 120. The main body 110 has a hollow cylindrical shape and is supplied with fine particulate fuel generated by the pulverizer 12. The ejection portion 120 is disposed at a downstream end of the main body 110 in the flow direction D of fuel. The ejection portion 120 communicates with the main body 110. The main body 110 and the ejection portion 120 are each provided with a flow space through which fuel is transferred. The fuel flows into the flow space of the main body 110 through its inlet and flows through the flow spaces of the main body 110 and the ejection portion 120 toward the outlet of the ejection portion 120.

The main body 110 has an inner surface that defines its flow space, and the inner surface includes a lower inner surface which extends obliquely downward from the inlet. The ejection portion 120 has an inner surface that defines its flow space, and the inner surface includes a lower inner surface which extends obliquely upward toward the outlet. In the first embodiment of the present disclosure, the first fuel transfer apparatus 100 is arranged horizontally. That is, referring to FIGS. 2 and 3, the first fuel transfer apparatus 100 according to the present disclosure is arranged such that the flow direction D of the fuel in the first fuel transfer apparatus 100 is perpendicular to the direction of gravity G. In the first embodiment of the present disclosure, the downward direction refers to the direction of gravity G and the upward direction refers to a direction opposite to the direction of gravity G.

Due to factors of the velocity of a fluid that carries the fuel being low or gravity being exerted on the first fuel transfer apparatus 100, it is possible that the fuel becomes settled on the inner surface of the pipe. In this case, since the fuel is distributed unevenly in the first fuel transfer apparatus 100, the fuel combustion efficiency of the combustor 13 that receives the fuel through the first fuel transfer apparatus 100 is reduced.

However, when the ejection portion 120 is formed in the shape illustrated in FIGS. 2 and 3, fuel particles hit the upwardly inclined inner wall surface of the ejection portion 120 and are then guided radially inward. Therefore, the first fuel transfer apparatus 100 according to the present disclosure prevents the fuel flowing through the pipe from settling on the lower inner surface of the pipe in the gravitational direction G and enables the fuel to be uniformly distributed along the entire flow path. Therefore, in the boiler facility 10 of the present disclosure, since the combustor 13 is supplied with a uniformly mixed fuel by the fuel transfer apparatus 100, the combustion efficiency of the combustor 13 is optimally maintained.

Referring to FIGS. 2 and 3, the main body 110 is shaped such that its diameter increases gradually in the flow direction D of the fuel. The ejection portion 120 is shaped such that its diameter decreases gradually along the flow direction D of the fuel in a manner that the inner surface of the ejection portion 120 is overall curved in the flow direction D. In this case, when the fluid flows through the inside of the first fuel transfer apparatus 100, the fluid first horizontally flows along the inner surface of the main body 110, then comes into contact with the inner surface of the ejection portion 120, and finally, due to inertia, flows upward along the inner surface of the ejection portion 120, i.e., a direction opposite to the direction of gravity G.

Figure 4:
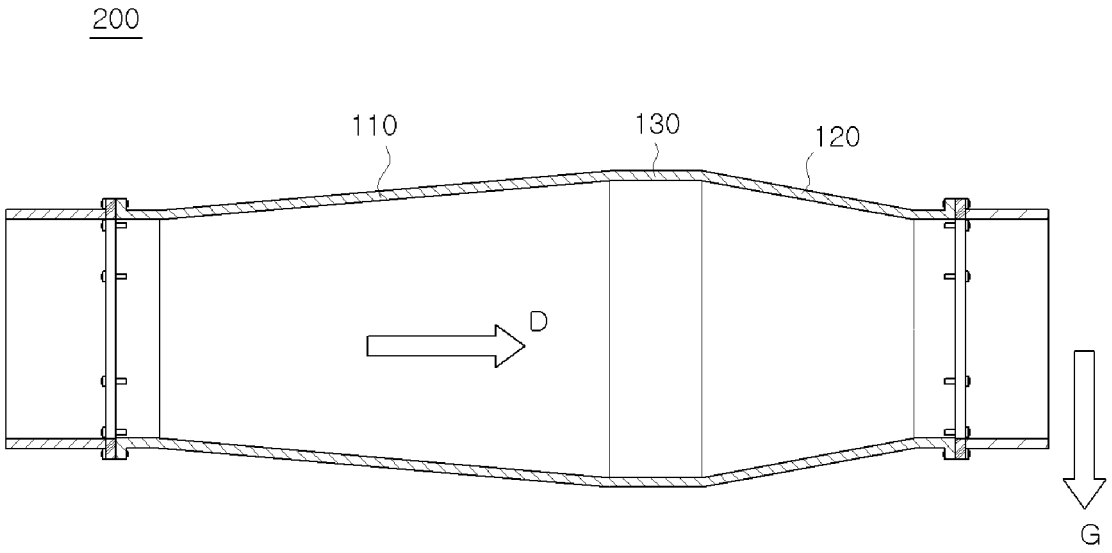
FIG. 4 is a diagram of the first fuel transfer apparatus according to a second embodiment of the present disclosure.

Hereinafter, a second embodiment of the present disclosure will be described with reference to FIG. 4. In describing the second embodiment, only the parts that differ from the first embodiment of the present disclosure will be described.

A first fuel transfer apparatus 200 in the second embodiment of the present disclosure further includes a connection portion 130. The connection portion 130 is provided between a main body 110 and an ejection portion 120. The connection portion 130 is shaped such that its diameter is constant along the flow direction D of the fuel. The ejection portion 120 is configured such that its diameter decreases along the flow direction D of the fuel. Unlike the first embodiment, in the ejection portion 120 in the second embodiment, the diameter decreases toward the outlet of the ejection portion 120 in a manner that the inner surface of the ejection portion 120 is linearly inclined in the flow direction D.

The first fuel transfer apparatus 200 according to the second embodiment of the present disclosure causes the fuel that flows, or floats, while in contact with the inner wall surface of the pipe in the direction of gravity G, thereby improving the fuel transfer efficiency.

Figure 5:
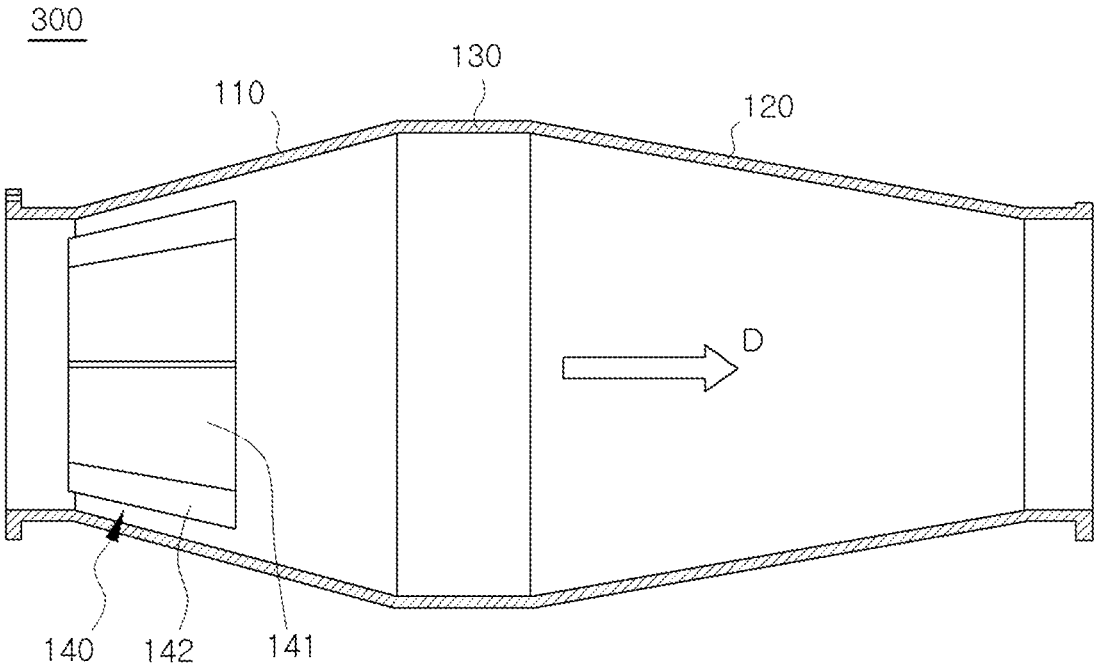
FIG. 5 is a diagram of the first fuel transfer apparatus according to a third embodiment of the present disclosure.
Figure 6:
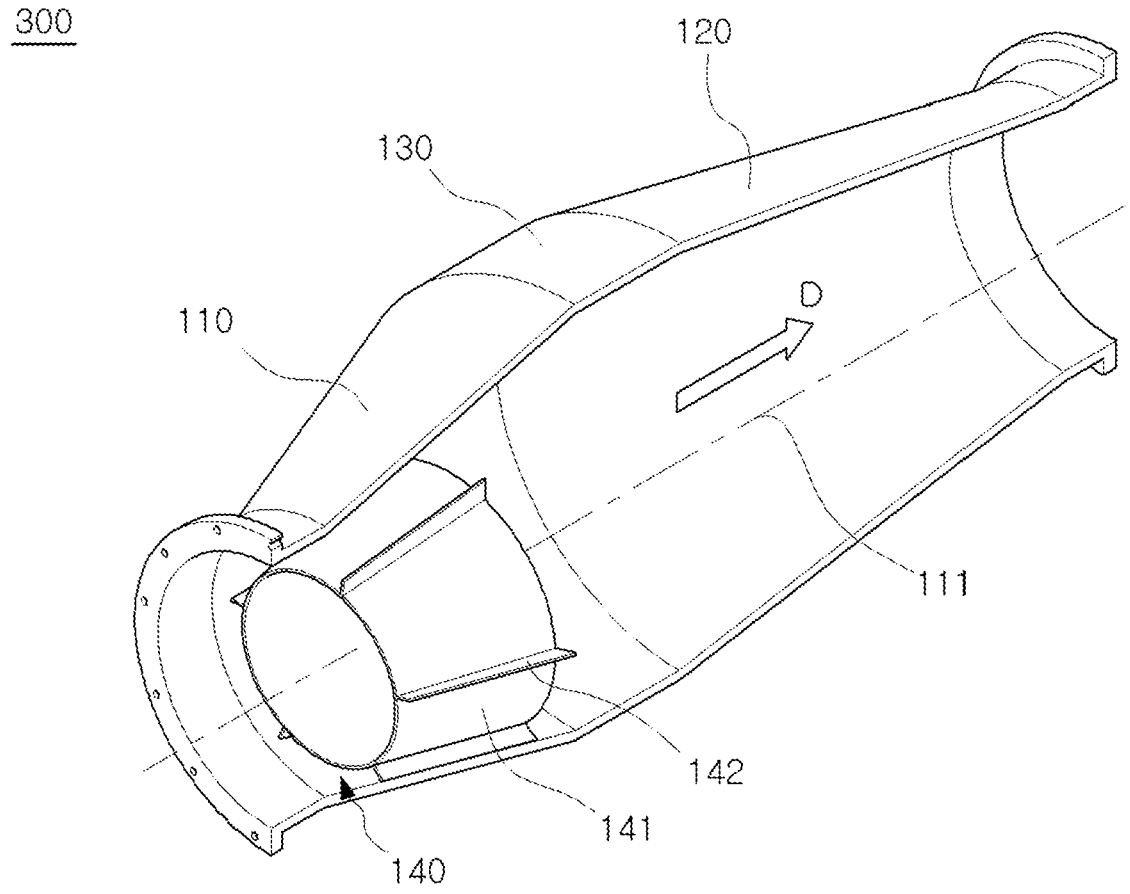
FIG. 6 is a cutaway perspective view of the first fuel transfer apparatus of FIG. 5.

Hereinafter, a third embodiment of the present disclosure will be described with reference to FIGS. 5 and 6. In describing the third embodiment, only the parts that differ from the second embodiment of the present disclosure will be described.

According to the third embodiment of the present disclosure, a first fuel transfer apparatus 300 further includes a swirler 140. The swirler 140 is installed in the main body 110 and creates a swirling flow of the fuel in the main body 110. In FIGS. 5 and 6, the first fuel transfer apparatus 300 according to the third embodiment of the present disclosure is horizontally arranged like the first fuel transfer apparatus illustrated in FIGS. 2 to 4. This is merely an exemplary illustration. The first fuel transfer apparatus 300 according to the third embodiment of the present disclosure is arranged such that the flow direction D of the fuel and the direction of gravity G are parallel to each other.

The swirler 140 includes a swirling body 141 and a plurality of supports 142 each having a ridge shape. The swirling body 141 is formed in a hollow cylinder shape and is spaced from the inner wall surface of the main body 110. The swirling body 141 has a shape corresponding to the shape of the main body 110. That is, the swirling body 141 is configured such that its diameter also increases in the flow direction D of the fuel. The multiple supports 142 are provided on the outer circumferential surface of the swirling body 141 and arranged to be spaced from each other in a circumferential direction of the swirling body 141. The multiple supports 142 are arranged to abut the inner wall surface of the main body 110, thereby supporting the swirling body 141.

Each of the multiple supports 142 is aligned with the central axis 111 of the main body 110. The supports 142 are arranged along a portion where an imaginary plane (not illustrated) that includes the central axis 111 of the main body 110 intersects the swirling body 141. Since the swirling body 141 is positioned to be concentric with the main body 110, the central axis 111 of the main body 110 is also the central axis of the swirling body 141. In the first fuel transfer apparatus 300 according to the third embodiment of the present disclosure, the swirling body 141 is fixedly disposed in the main body 110 by the supports 142 so that the fine particulate fuel introduced into the main body 110 is uniformly dispersed in the main body 110 by the swirling body 141 and the supports 142.

Figure 7:
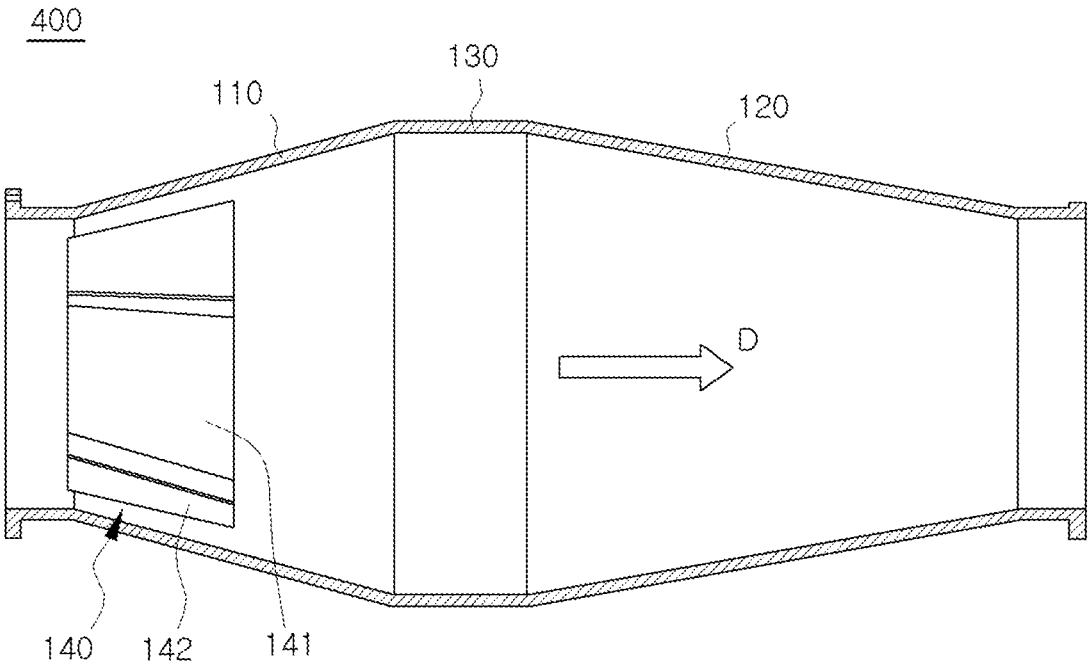
FIG. 7 is a diagram of the first fuel transfer apparatus according to a fourth embodiment of the present disclosure.
Figure 8:
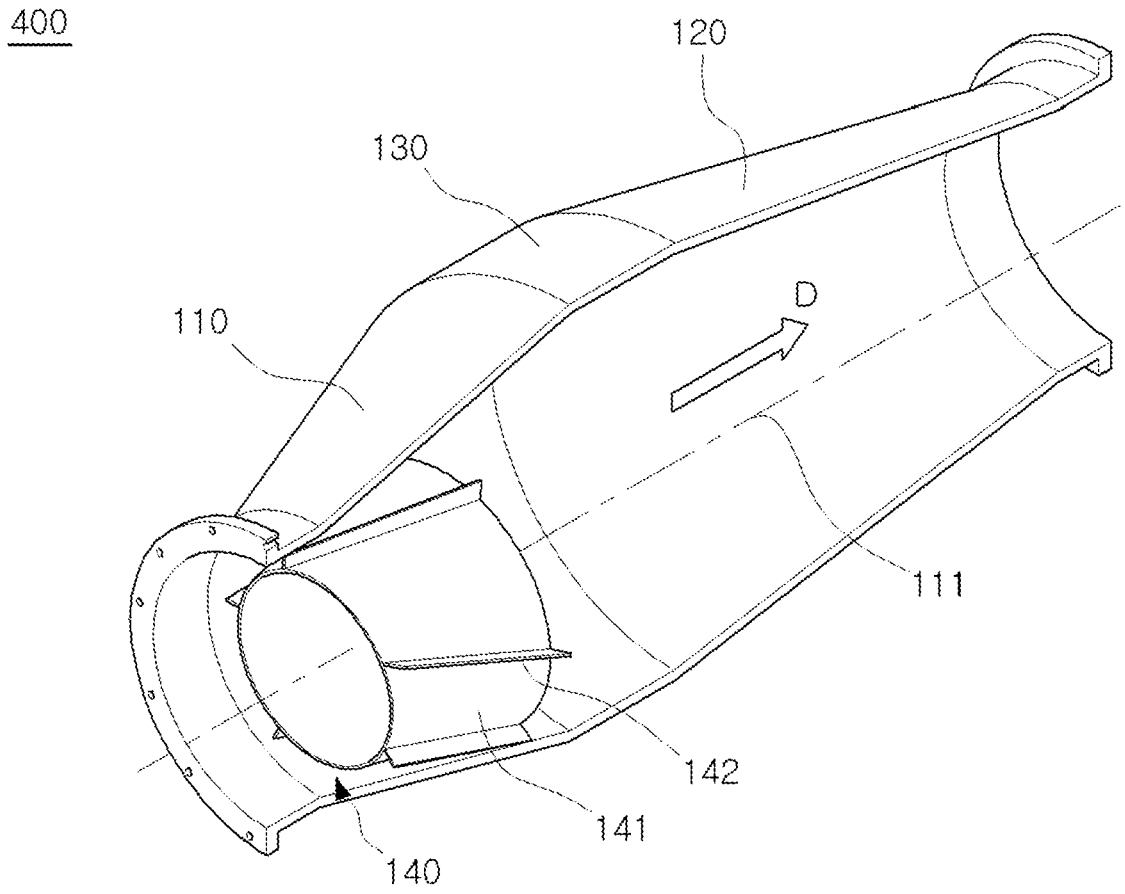
FIG. 8 is a cutaway perspective view of the first fuel transfer apparatus of FIG. 7.

Next, a fourth embodiment of the present disclosure will be described with reference to FIGS. 7 and 8. In describing the fourth embodiment, only the parts that differ from the third embodiment of the present disclosure will be described.

According to the fourth embodiment of the present disclosure, a first fuel transfer apparatus 400 is configured such that each of the multiple supports 142 is misaligned (i.e., inclined) with the central axis 111 of the main body 110. More particularly, assuming an imaginary plane (not illustrated) that includes the central axis of the main body 10 and an upstream end of one of the supports 142, a downstream end of the support is shifted from the imaginary plane in a circumferential direction of the swirling body 141.

In this case, the fuel introduced into the main body 110 to pass through the swirler 140 swirls along the circumferential direction of the swirling body 141 due to the supports 142 being inclined with respect to the central axis of the main body. Accordingly, the first fuel transfer apparatus 400 according to the fourth embodiment of the present disclosure causes a swirling flow of the fuel introduced into the ejection portion 12 via the main body 110, thereby uniformly dispersing the fuel in the pipe and maintaining the optimum combustion efficiency of the combustor 13.

In FIGS. 5 to 8, the swirler 140 is installed in the main body 110 of the first fuel transfer apparatus 200 according to the second embodiment of the present disclosure. However, the present disclosure is not limited to this configuration, and the swirler 140 may be installed in the main body 110 of the first fuel transfer apparatus 100 according to the first embodiment of the present disclosure.

Hereinafter, a second fuel transfer apparatus according to the present disclosure will be described with reference to FIGS. 9 through 21.

Figure 9:
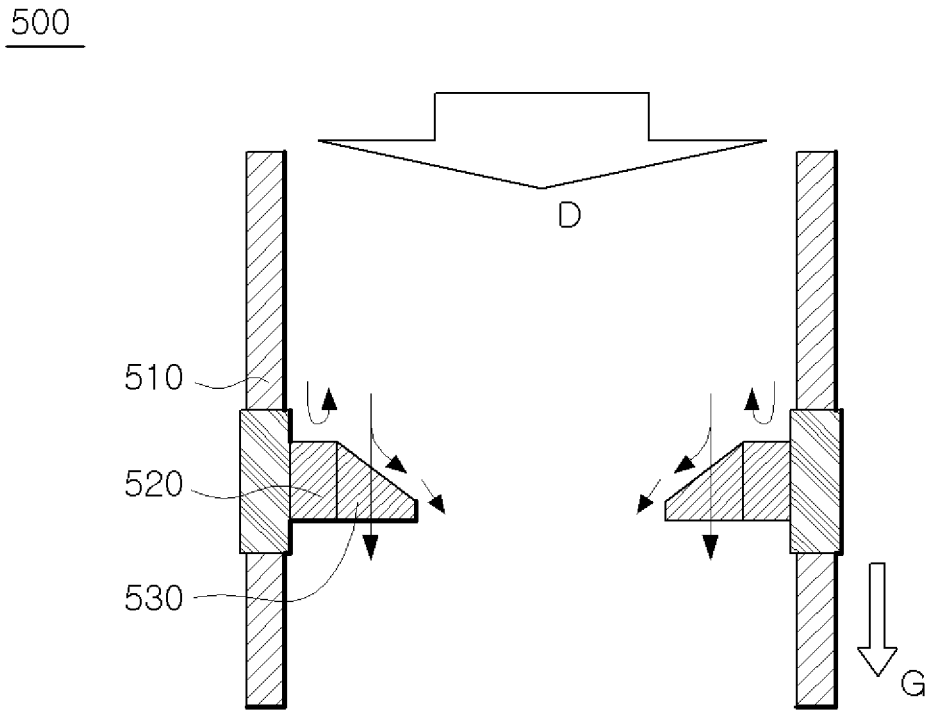
FIG. 9 is a cross-sectional view of a second fuel transfer apparatus of FIG. 1 according to a fifth embodiment of the present disclosure.
Figure 10:
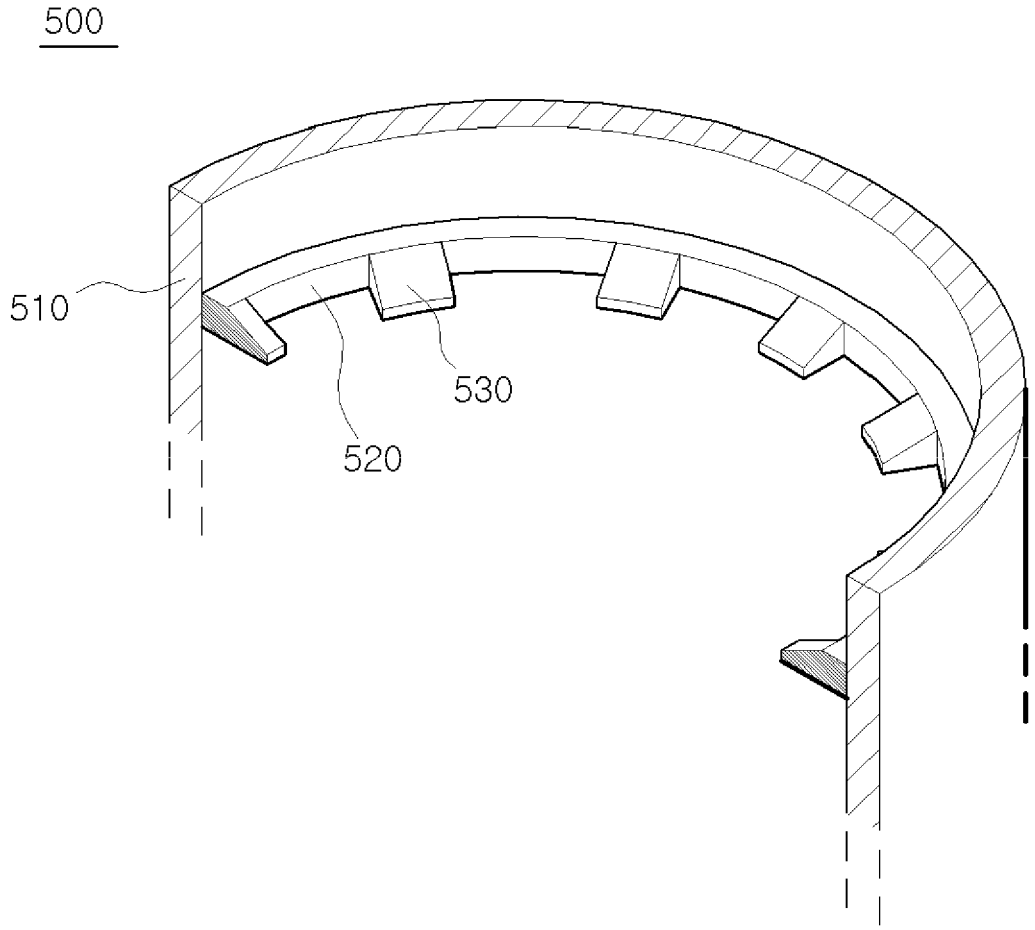
FIG. 10 is a perspective view of the structure of FIG. 9.

Referring to FIGS. 9 and 10, according to a fifth embodiment of the present disclosure, a second fuel transfer apparatus 500 includes a transfer pipe 510, a diffuser 520, and a guide 530. The transfer pipe 510 takes the form of a hollow tube and has a flow space through which fuel flows. The diffuser 520 has an annular shape and is installed such that its outer circumferential surface is in contact with the inner circumferential surface of the transfer pipe 510. The guide 530, which a plurality of guides, is installed on the inner circumferential surface of the diffuser 520. That is, the second fuel transfer apparatus 500 may include multiple guides 530 arranged at intervals in the circumferential direction of the diffuser 520.

Each guide 530 has an upper surface that obliquely extends downward in the flow direction D of the fuel. In the view of FIG. 9, the direction of gravity G is an up-to-down direction and the fuel flows from the upper side to the lower side. That is, the flow direction D of the fuel agrees with the direction of gravity G. Therefore, in FIG. 9, an upper portion in terms of the direction of gravity G corresponds to an upstream portion in terms of the flow direction D of the fuel, and a lower portion in terms of the direction of gravity G corresponds to a downstream portion in terms of the flow direction D of the fuel.

Each guide 530 includes an upper surface (i.e., the upstream-side surface in the flow direction D of the fuel) that is inclined downward, toward the downstream side in the flow direction D of the fuel and toward the radial center of the transfer pipe 510. Therefore, when the fuel flows in a state of being locally concentrated at a portion of the inner surface of the transfer pipe 510, the fuel is guided along the inclined upper surfaces of the guides 530 so that the fuel moves toward the center of the transfer pipe 510. Accordingly, the second fuel transfer apparatus 500 according to the present disclosure and the boiler facility 10 including the same enables the fuel to flow through the transfer pipe 510 in a state of being uniformly distributed over the entire cross sectional area of the transfer pipe, thereby improving the combustion efficiency of the combustor 13. In addition, the fuel transfer apparatus 500 according to the present disclosure and the boiler facility 10 including the same invention has an advantage of reducing the wear of the guides 530 because their inclined upper surfaces reduce an impact angle of the fuel with respect to the guides 530.

The diffuser 520 includes an upper surface that is perpendicular to the inner surface of the transfer pipe 510. In this case, the fuel flowing through the transfer pipe 510 perpendicularly collides with the upper surface of the diffuser 520. The second fuel transfer apparatus 500 and the boiler facility 10 including the same may be configured such that the fuel flowing along the inner surface of the transfer pipe 510 first collides with the diffuser 520 and then flows along the guides 530. Therefore, the fuel is uniformly distributed over the entire cross sectional area of the transfer pipe 510 when the fuel flows through the transfer pipe 510.

Hereinafter, sixth to ninth embodiments of the present disclosure will be described with reference to FIGS. 11 to 15. In describing each of the sixth to ninth embodiments, only the parts that differ from the fifth embodiment of the present disclosure will be described.

Figure 11:
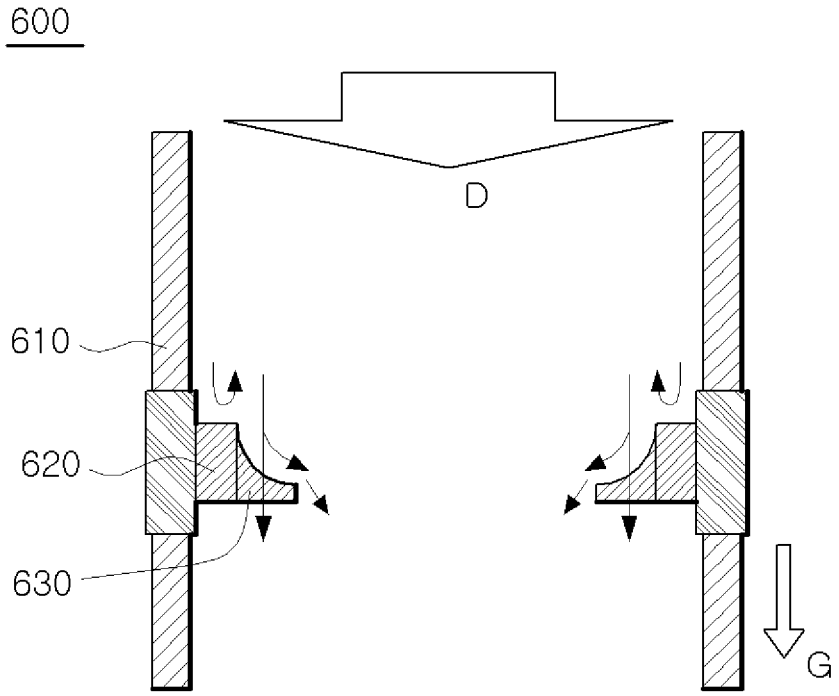
FIG. 11 is a diagram of the second fuel transfer apparatus according to a sixth embodiment of the present disclosure.
Figure 12:
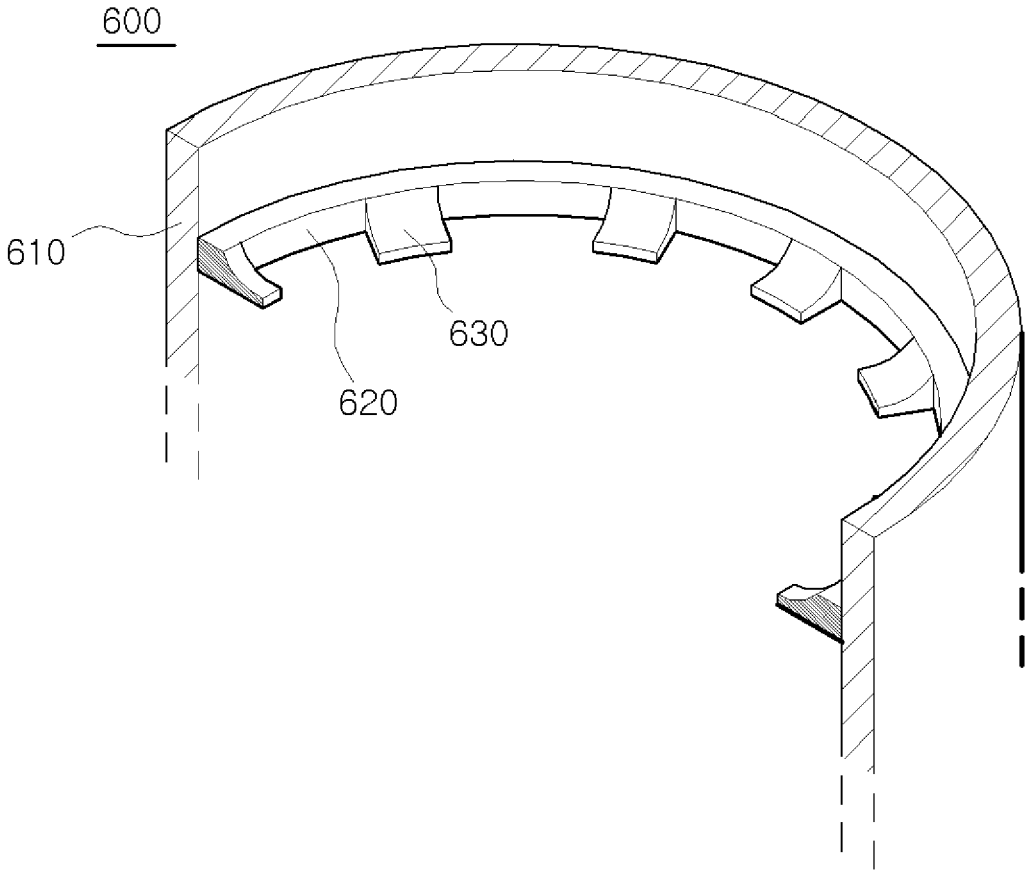
FIG. 12 is a perspective view of the structure of FIG. 11.

Referring to FIGS. 11 and 12, according to the sixth embodiment of the present disclosure, a second fuel transfer apparatus 600 includes a guide 630 having an upper surface that is concavely curved. According to the sixth embodiment of the present disclosure, the fuel approaches the upper surface of the guide 630 and smoothly flows along the curved surface of the guide 630 so that the fuel naturally moves toward the center of a transfer pipe 610. Therefore, the impact angle of the fuel with respect to the guide 630 is reduced, thereby preventing the guide 630 from being worn.

Figure 13:
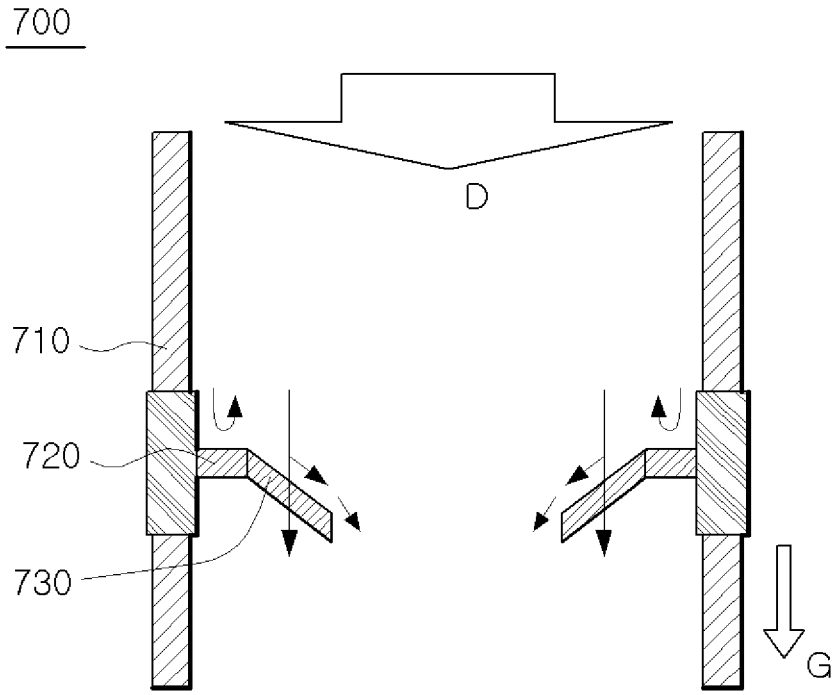
FIG. 13 is a diagram of the second fuel transfer apparatus according to a seventh embodiment of the present disclosure.

Referring to FIG. 13, according to the seventh embodiment of the present disclosure, a second fuel transfer apparatus 700 includes a guide 730 having a plate shape. The guide 730 extends obliquely downward toward the radial center of the transfer pipe 710. This configuration enables the guide 730 to uniformly distribute the fuel in the transfer pipe 710.

Figure 14:
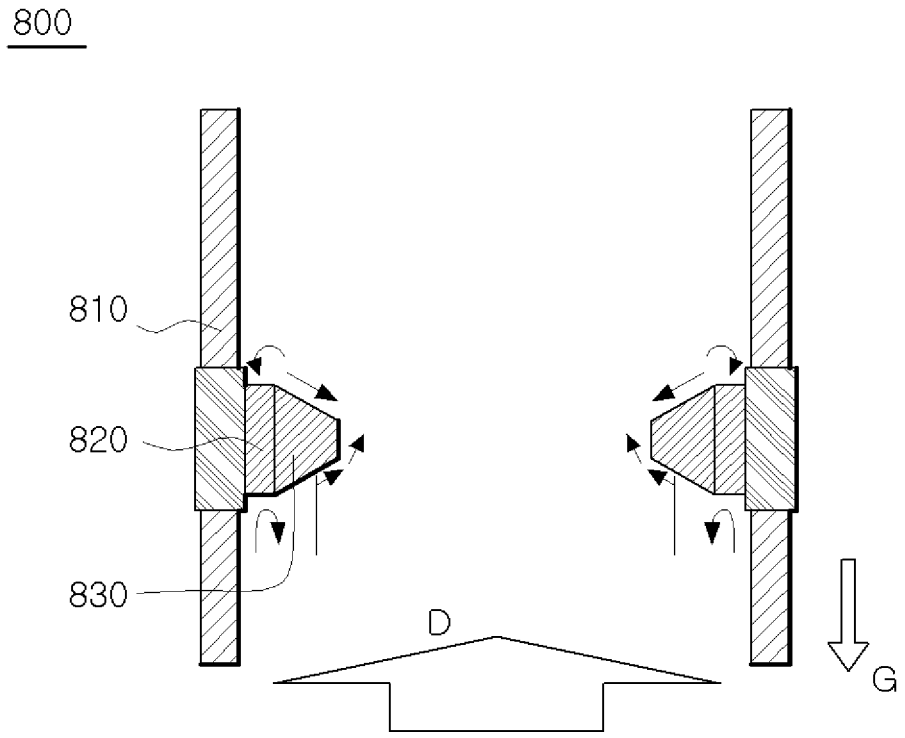
FIG. 14 is a diagram of the second fuel transfer apparatus according to an eighth embodiment of the present disclosure.
Figure 15:
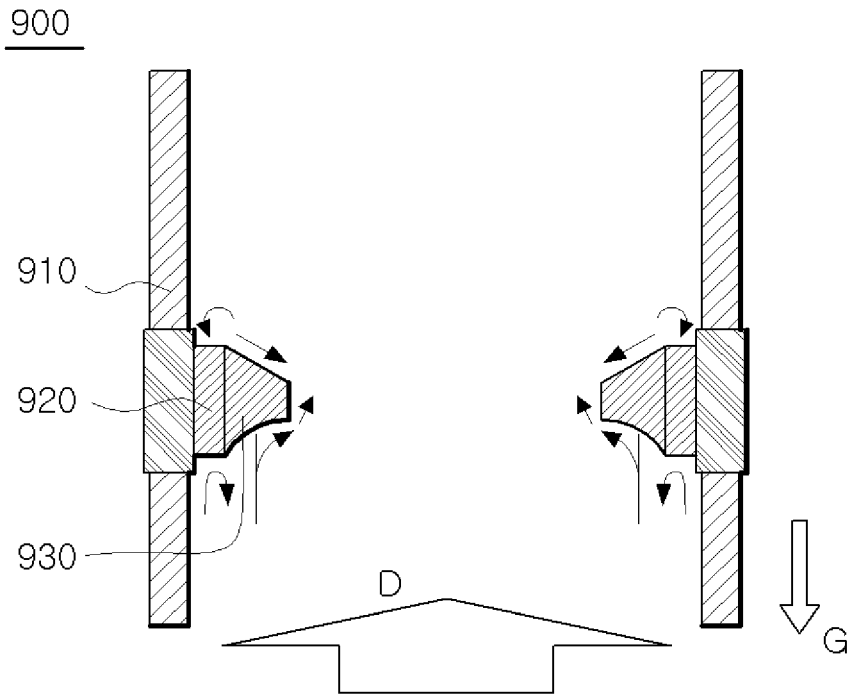
FIG. 15 is a diagram of the second fuel transfer apparatus according to a ninth embodiment of the present disclosure.

In FIGS. 14 and 15, it is assumed that the flow direction D of the fuel is a down-to-up direction. That is, the fuel flows upward, such that the flow direction D of the fuel in FIGS. 14 and 15 is opposite to the direction of gravity G. Therefore, in FIGS. 14 and 15, a lower portion with respect to the direction of gravity G corresponds to an upstream portion with respect to the flow direction D of the fuel, and an upper portion with respect to the direction of gravity G corresponds to a downstream portion with respect to the flow direction D of the fuel.

Referring to FIG. 14, in a fuel transfer apparatus 800 according to the eighth embodiment of the present disclosure, a guide 830 is formed such that the lower surface (that is, surface on the upstream side in the flow direction D of the fuel) extends obliquely upward, toward the downstream side in the flow direction D of the fuel and toward the radial center of a transfer pipe 810. The guide 830 is formed such that the upper surface (i.e., surface on the downstream side in the flow direction D of the fuel) extends obliquely downward, toward the downstream side in the flow direction D of the fuel and toward the radial center of the transfer pipe 810.

Referring to FIG. 15, according to the ninth embodiment of the present disclosure, a fuel transfer apparatus 900 includes a guide 930 having a lower surface that is concave-curved, from the outer end to the inner end, in the radial direction of a transfer pipe 910. The guide 930 is formed such that the upper surface is inclined downward (i.e., toward the upstream side in terms of the flow direction D), from the outer end to the inner end, in the radial direction of the transfer pipe 910.

When the flow direction D of the fuel is opposite to the direction of gravity G, the fuel passing through the guide 830 or 930 resides on the upper surface (downstream side surface) of the diffuser 820 or 920, or forms a vortex on the upper surface of the diffuser 820 or 920. According to the eighth and ninth embodiments of the present disclosure, when the upper surface (downstream side surface) of the guide 830 is inclined downward (toward the upstream side), from the outer end to the inner end, in the radial direction of the transfer pipe 810 or 910, the inclined upper surface of the guide 830 or 930 can guide the fuel on the upper surface of the diffuser 820 or 920 toward the radial center of the transfer pipe 810 or 910. Accordingly, the second fuel transfer apparatus 800 or 900 according to the eighth or ninth embodiment of the present disclosure can prevent the fuel from residing on the upper portion (downstream portion) of the diffuser 820 or 920 and can reduce the size of the vortex formed on the upper portion (downstream portion) of the diffuser 820 or 920.

Figure 16:
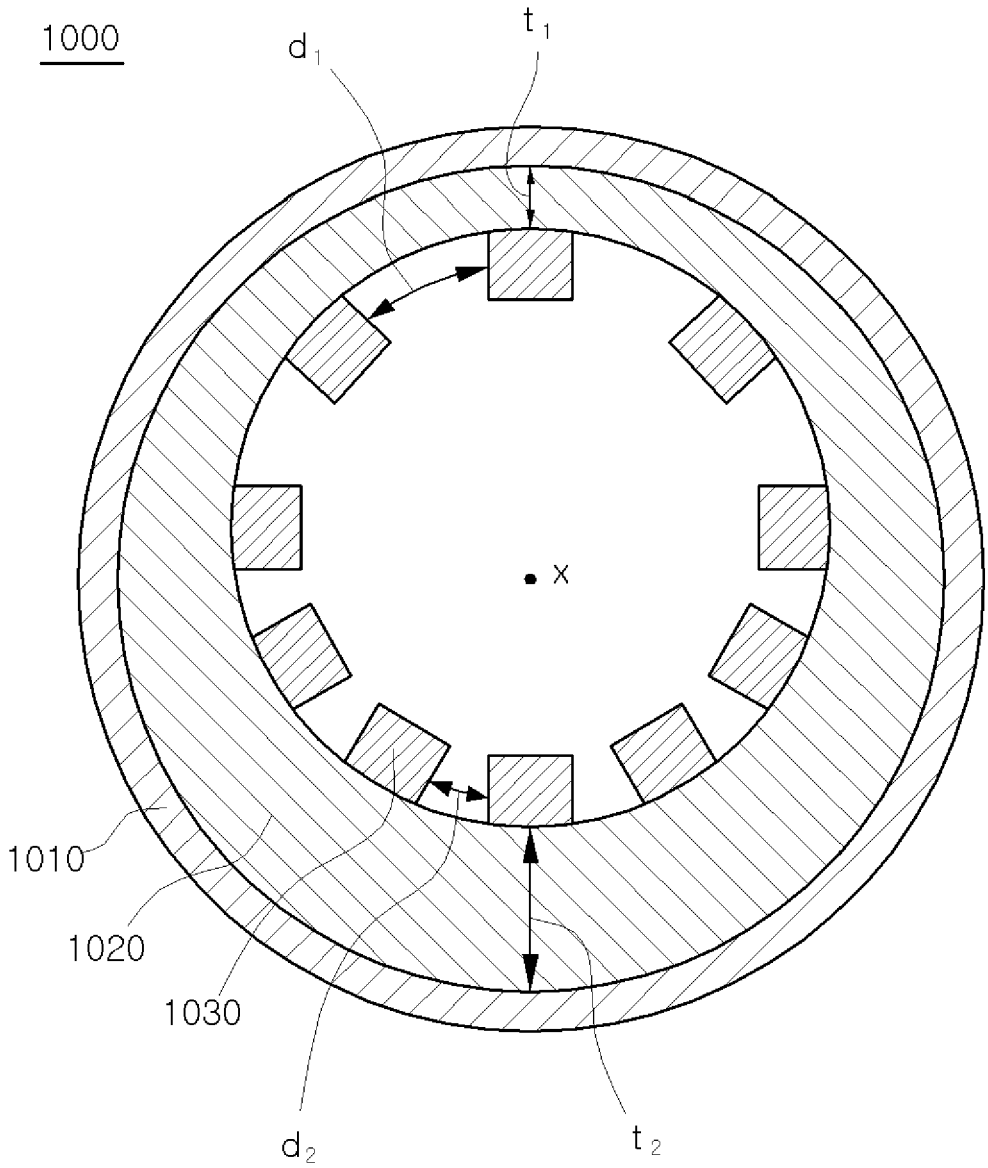
FIG. 16 is a diagram of the second fuel transfer apparatus according to a tenth embodiment of the present disclosure.

In FIG. 16, it is assumed that the flow direction D of the fuel is a direction perpendicular to the drawing view and the direction of gravity G is a direction from one side to the other of the drawing view. In FIG. 16, it is assumed that the flow direction D and the direction of gravity G of the fuel are orthogonal to each other.

Referring to FIG. 16, according to the tenth embodiment of the present disclosure, a second fuel transfer apparatus 1000 includes a diffuser 1020 and a transfer pipe 1010. The diffuser 1020 is formed such that a radial thickness t1 on a first side of the transfer pipe 1010 with respect to the central axis X of the transfer pipe 1010 is smaller than a radial thickness t2 on a second side of the transfer pipe opposite to the first side. An interval d1 between the guides 1030 disposed on the first side is longer than an interval d2 between the guides 1030 disposed on the second side. The guide 1030 in the tenth embodiment of the present disclosure may have any shape selected from the shapes of the guides 530, 630, 730, 830, and 930 in the fifth to ninth embodiments of the present disclosure.

According to the tenth embodiment of the present disclosure, since the number of the guides 1030 per unit area on the second side of the transfer pipe 1010 is larger than the number of the guides per unit area on the first side of the transfer pipe 1010, the fuel that flows along the inner surface of the second side of the transfer pipe 1010 is effectively guided toward the first side by the guides 1030. Accordingly, according to the tenth embodiment of the present invention, it is possible to prevent the fuel flowing through the transfer pipe 1010 from being concentrated in a lower portion of the pipe (in the direction of gravity G), thereby evenly distributing the fuel in the entire region of the pipe.

Although not illustrated in FIG. 16, the guides 1030 disposed on the first side may differ in shape from the guides 1030 disposed on the second side. For example, the guides 1030 disposed on the first side have the same shape as the guides 530 described in the fifth embodiment of the present disclosure, and the guides 1030 disposed on the second side have the same shape as the guides 730 described in the seventh embodiment of the present disclosure. The shapes of the guides 1030 disposed on the first side and the second side may be determined depending on the angle of the flow direction D of the fuel with the direction of gravity G, the difference between the thickness t1 of the first portion of the diffuser 1020 and the thickness t2 of the second portion of the diffuser 1020, or the like.

Hereinafter, eleventh to fourteenth embodiments of the present disclosure will be described with reference to FIGS. 17 to 21.

Figure 17:
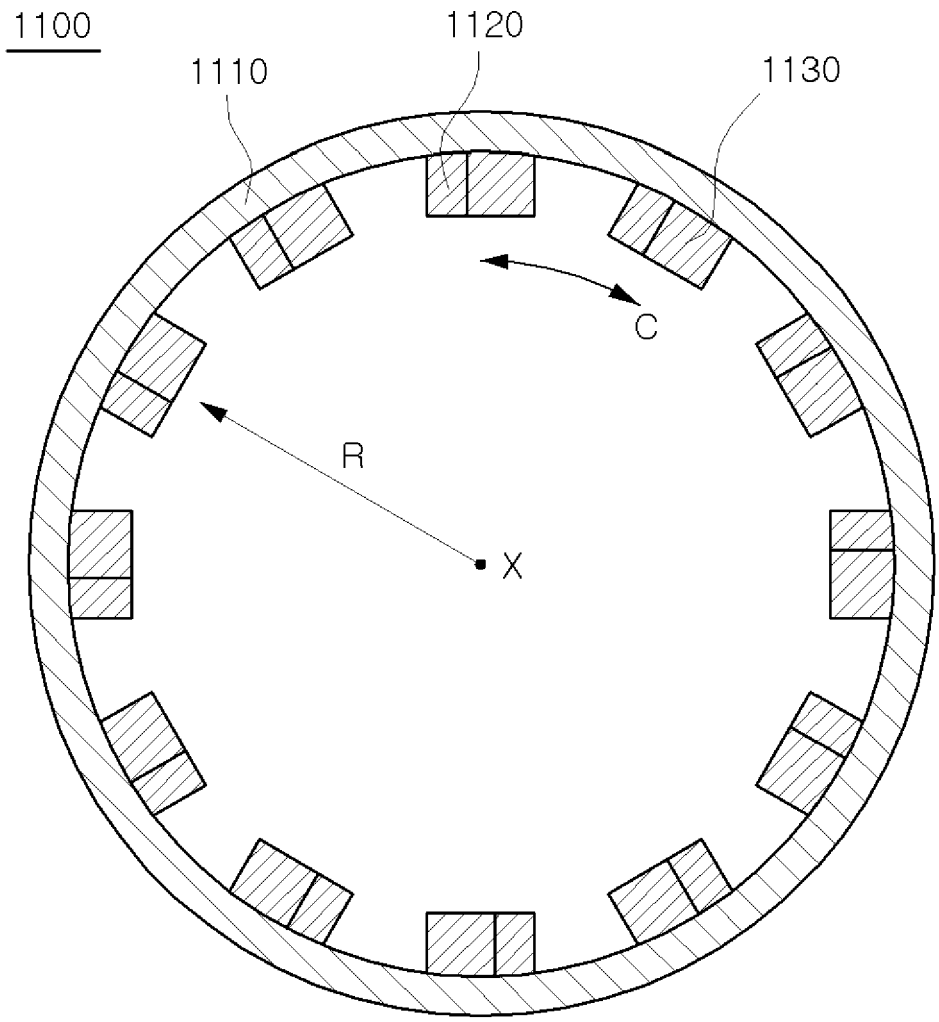
FIG. 17 is a diagram of the second fuel transfer apparatus according to an eleventh embodiment of the present disclosure.
Figure 18:
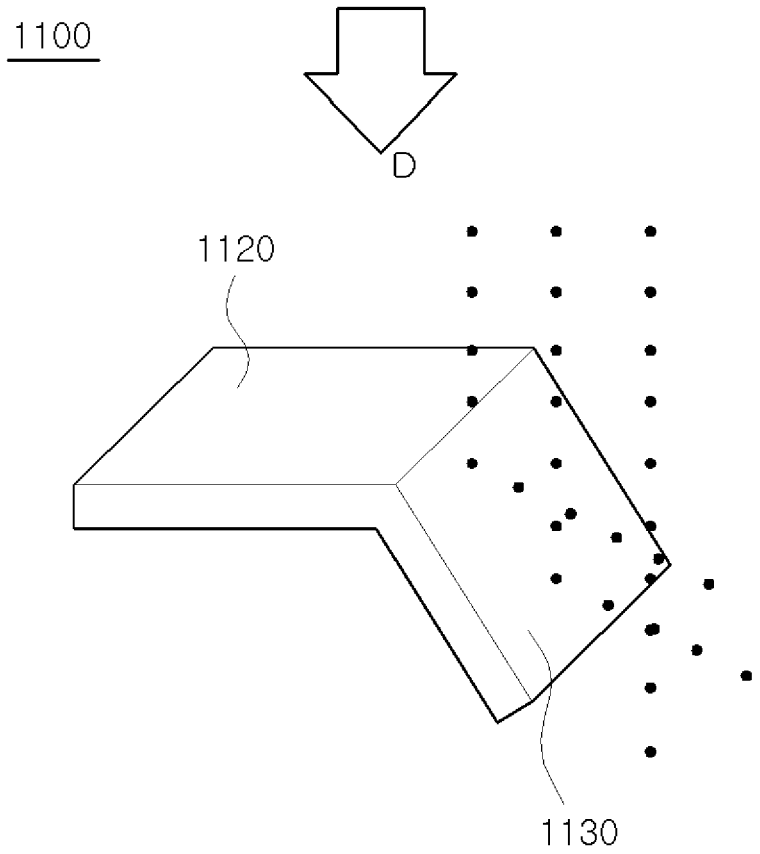
FIG. 18 is a perspective view of a diffuser and guide disposed along a radial direction of a transfer pipe of FIG. 17.

Referring to FIGS. 17 and 18, according to the eleventh embodiment of the present disclosure, a fuel transfer apparatus 1100 includes multiple diffusers 1120 arranged at intervals in a circumferential direction C of a transfer pipe 1110 rather than an annular shape as in the first to tenth embodiments of the present disclosure. Guides 1130 are disposed at respective ends of each diffuser in the circumferential direction C of the transfer pipe 1110. In FIG. 18, fuel flows downward. That is, the flow direction D of the fuel is from the top to the bottom of the view of FIG. 18. The flow direction D of the fuel agrees with the direction of gravity G. Therefore, in FIG. 18, an upper portion corresponds to an upstream portion in the flow direction D of the fuel, and a lower portion corresponds to a downstream portion in the flow direction D of the fuel.

The upper surface of the guide 1130 obliquely extends downward from the diffuser 1120 in the circumferential direction C of the transfer pipe 1110. According to the eleventh embodiment of the present disclosure, since the fuel that flows through the transfer pipe 1110 is guided by the guides 1130, the fuel flows along the circumferential direction C of the transfer pipe 1110. According to the eleventh embodiment of the present disclosure, the fuel is swirled in the circumferential direction C of the transfer pipe 1110, so that the fuel can be evenly mixed in the entire region of the transfer pipe 1110.

Figure 19:
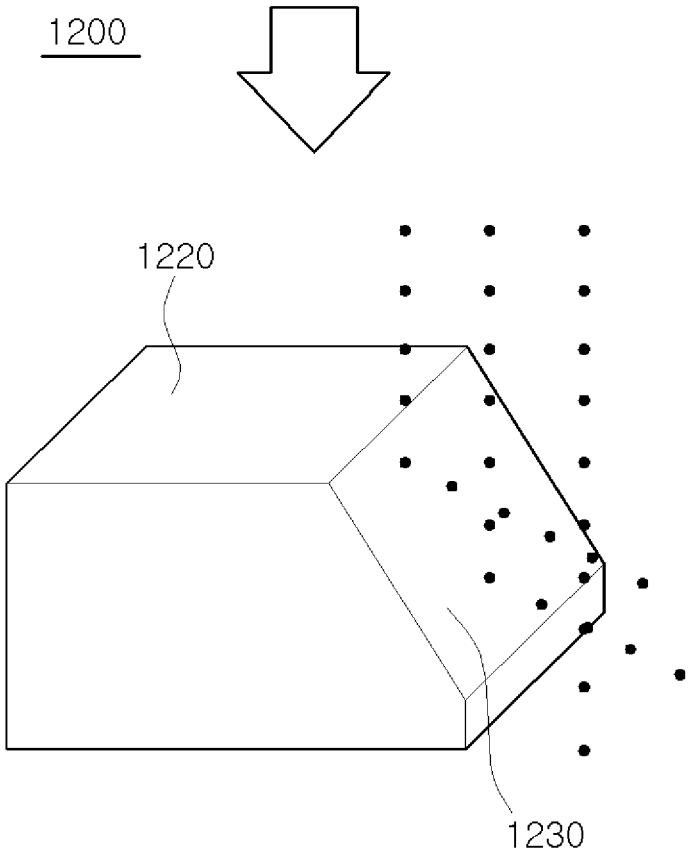
FIG. 19 is a perspective view of the diffuser and guide according to a twelfth embodiment of the present disclosure.

Referring to FIG. 19, according to the twelfth embodiment of the present disclosure, a fuel transfer apparatus 1200 includes a guide 1230 having a plate shape. The guide 1230 extends obliquely downward from the diffuser 1220 in the circumferential direction C of a transfer pipe 1210. According to the twelfth embodiment of the present disclosure, the fuel is swirled in the circumferential direction C of the transfer pipe 1210 so that the fuel can be evenly mixed in the entire region of the transfer pipe 1210.

Figure 20:
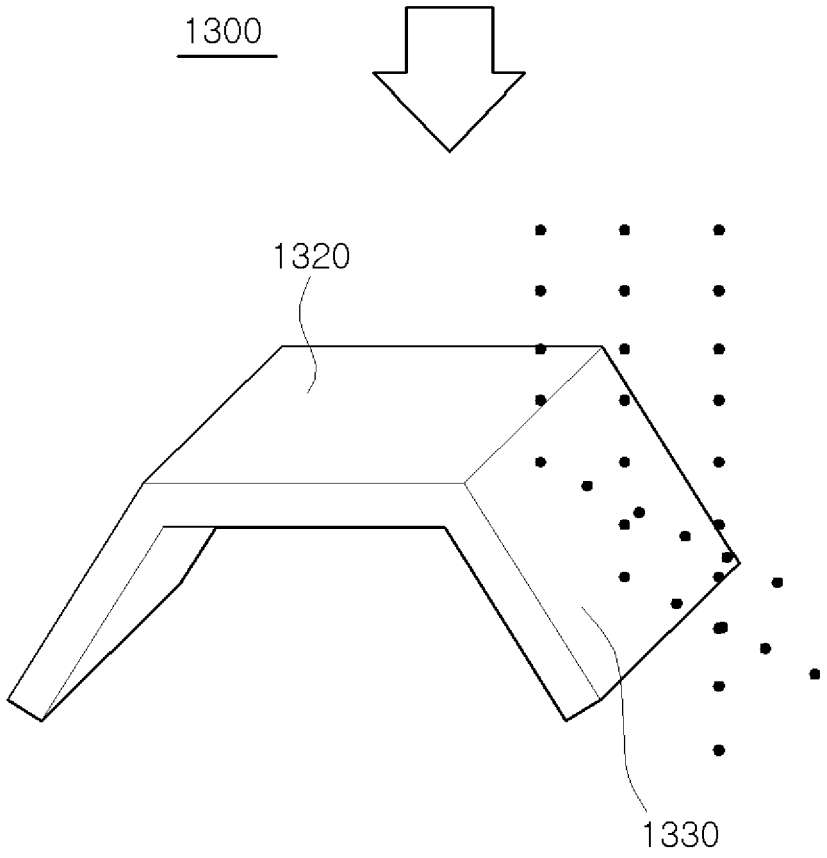
FIG. 20 is a perspective view of the diffuser and guide according to a thirteen embodiment of the present disclosure.
Figure 21:
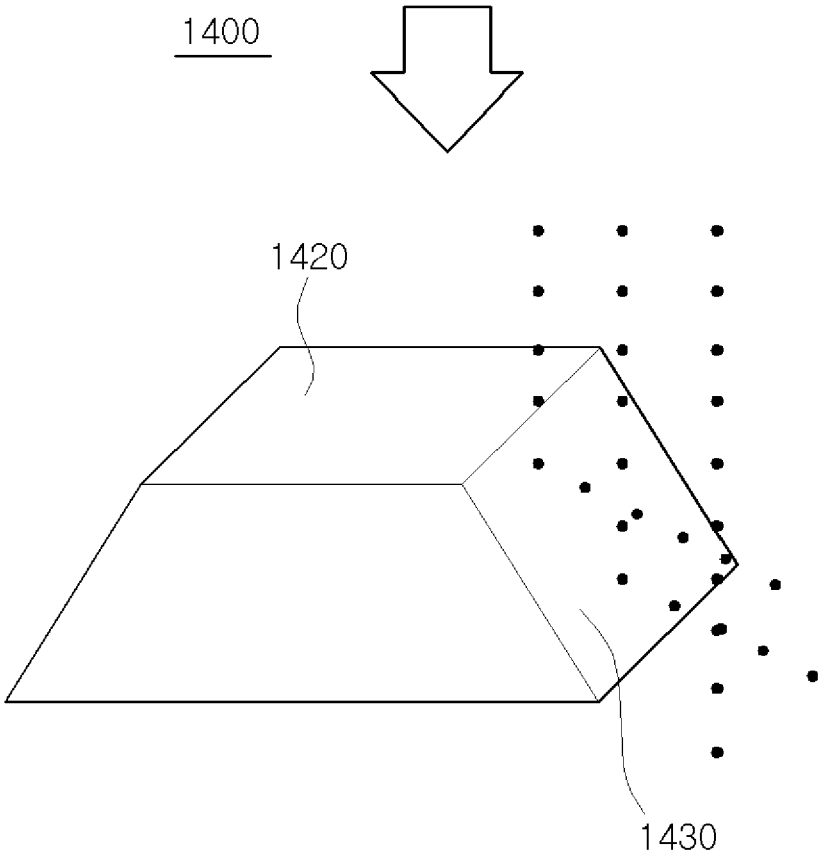
FIG. 21 is a perspective view of the diffuser and guide according to a fourteenth embodiment of the present disclosure.

Referring to FIGS. 20 and 21, in each of the fuel transfer apparatuses 1300 and 1400 according to the thirteenth embodiment and the fourteenth embodiment of the present disclosure, each diffuser 1320 (or 1420) is provided with a pair of guides 1330 (or 1430). Each of the guides 1330 in each pair in the thirteenth embodiment of the present disclosure is the same as the guide 1130 in the eleventh embodiment, and each of the guides 1430 in each pair in the fourteenth embodiment of the present disclosure is the same as the guide 1230 in the twelfth embodiment of the present disclosure. When viewing the guides 1330 (or 1430) and the diffusers 1320 (or 1420) from the radial direction R of the transfer pipe 1310 (or 1410), one diffuser 1320 (or 1420) is disposed between two guides 1330 (or 1430) that are in a pair. Accordingly, the fuel transfer apparatus 1300 (or 1400) according to the thirteenth (or fourteenth) embodiment of the present disclosure can guide the fuel supplied from above the diffuser 1320 (or 1420) toward the left side and the right side of the diffuser 1320 (or 1420), thereby evenly mixing the fuel flowing through the transfer pipe 1310 (or 1410). While the present disclosure has been described with reference to exemplary embodiments, those skilled in the art will appreciate that the exemplary embodiments are presented only for illustrative purposes and the present disclosure is not limited to the disclosed exemplary embodiments. On the contrary, it will be understood that various modifications and equivalents thereof are possible. Accordingly, the true technical protection scope of the present disclosure should be determined by the technical idea defined in the appended claims.

What is claimed is:

1. An apparatus for transporting fine particulate fuel to a combustor, the apparatus comprising:

a main body having a flow space through which fuel is transferred in a flow direction; and a swirler installed in the main body and configured to create a swirling flow of the fuel flowing through the main body, wherein the swirler comprises:

a swirling body that includes a hollow and is spaced apart from an inner wall of the main body; and a plurality of ridge-shaped supports installed on and fixed to an outer circumferential surface of the swirling body and arranged to abut an inner surface of the main body, the plurality of ridge-shaped supports configured to support the swirling body against the inner wall of the main body, wherein the swirling body has a diameter that increases in the flow direction of the fuel, and wherein each of the plurality ridge-shaped supports includes an upstream end and a downstream end, and a distance between the upstream ends of the ridge-shaped supports is shorter than a distance between the downstream ends of the ridge-shaped supports.

2. The apparatus according to claim 1, wherein the plurality of ridge-shaped supports are spaced apart from each other in a circumferential direction of the main body, and wherein each of the plurality of ridge-shaped supports is inclined relative to a central axis of the main body.

3. The apparatus according to claim 2, wherein the upstream ends of the ridge-shaped supports meet an imaginary plane that includes the central axis of the main body, and wherein the downstream ends of the ridge-shaped supports are shifted from the imaginary plane in the circumferential direction.

4. The apparatus according to claim 1, wherein the diameter of the swirling body increases in the flow direction of the fuel in correspondence to a shape of the main body.

5. The apparatus according to claim 1, wherein each of the plurality of ridge-shaped supports is formed as a continuous ridge that protrudes from the outer circumferential surface of the swirling body in a radial direction and that extends in an axial direction from a downstream end of the swirling body to an upstream end of the swirling body.

* * * * *